US009896837B2

(12) United States Patent
Matteson

(10) Patent No.: US 9,896,837 B2
(45) Date of Patent: Feb. 20, 2018

(54) FAIL-SOFT, GRACEFUL DEGRADATION, STRUCTURAL FUSE APPARATUS AND METHOD

(71) Applicant: Thor Matteson, Berkeley, CA (US)

(72) Inventor: Thor Matteson, Berkeley, CA (US)

( * ) Notice: Subject to any disclaimer, the term of this patent is extended or adjusted under 35 U.S.C. 154(b) by 0 days.

(21) Appl. No.: 15/354,787

(22) Filed: Nov. 17, 2016

(65) Prior Publication Data

US 2017/0067249 A1 Mar. 9, 2017

Related U.S. Application Data

(60) Continuation-in-part of application No. 15/226,058, filed on Aug. 2, 2016, now abandoned, which is a
(Continued)

(51) Int. Cl.
*E04B 1/98* (2006.01)
*E04H 9/02* (2006.01)
(Continued)

(52) U.S. Cl.
CPC ..... *E04B 1/985* (2013.01); *E04C 3/32* (2013.01); *E04H 9/021* (2013.01); *E04H 9/024* (2013.01);
(Continued)

(58) Field of Classification Search
CPC .... E04B 1/985; E04B 2001/2442; E04B 1/98; E04B 2001/2469; E04C 2003/0434;
(Continued)

(56) References Cited

U.S. PATENT DOCUMENTS 3,050,831 A 8/1962 Diamond
3,283,464 A 11/1966 Litzka
(Continued)

OTHER PUBLICATIONS

University of Hawaii College of Engineering, Department of Civil and Environment Engineering, Hybrid Masonry Connector Plate and Headed Stud Small-Scale Wall Testing Research Report UHM/CEE/12-06 by James Aoki and Ian N. Robertson, Dec. 2012.
(Continued)

*Primary Examiner* — Chi Q Nguyen
(74) *Attorney, Agent, or Firm* — Pate Baird, PLLC

(57) ABSTRACT

A retrofitting structure includes a column fixed in the ground. A structural fuse is pivotally mounted to the retrofitting structure at two vertically offset locations. The structural fuse is further pivotally mounted at a third location above the column to a superstructure of a building. The structural fuse is designed to yield for loads for which the column only deforms elastically. The structural fuse may be a planar member captured between the column and a retention plate to prevent buckling of the structural fuse. The retention plate may include a channel beam in order to provide sufficient stiffness to prevent buckling. Desired yield properties are obtained by increasing width of the structural fuse with distance from the bottom of the column. The width is augmented with distance from the bottom of the column to account for friction with the column and retention plate.

13 Claims, 8 Drawing Sheets

Related U.S. Application Data division of application No. 14/607,680, filed on Jan. 28, 2015, now Pat. No. 9,441,360.

(60) Provisional application No. 61/965,339, filed on Jan. 28, 2014, provisional application No. 62/287,985, filed on Jan. 28, 2016, provisional application No. 62/397,412, filed on Sep. 21, 2016.

(51) Int. Cl.
*E04C 3/32* (2006.01)
*E04C 3/04* (2006.01)
*E04B 1/24* (2006.01)

(52) U.S. Cl.
CPC ..... *E04B 2001/2442* (2013.01); *E04C 2003/0434* (2013.01); *E04C 2003/0452* (2013.01); *E04H 9/028* (2013.01)

(58) Field of Classification Search
CPC ... E04C 3/32; E04C 2003/0452; E04H 9/021; E04H 9/024; E04H 9/028; E04H 9/022; E04H 9/00; E04H 9/027; E04H 9/02; E04H 2009/026
USPC ... 52/167.1, 167.8, 167.6, 167.2, 653.1, 848
See application file for complete search history.

(56) References Cited

U.S. PATENT DOCUMENTS 3,927,499 A 12/1975 Papayoti et al.
3,963,099 A 6/1976 Skinner
4,038,799 A 8/1977 Shanks
4,047,541 A 9/1977 Mercier et al.
4,263,762 A 4/1981 Reed et al.
4,516,874 A 5/1985 Yang et al.
4,793,113 A 12/1988 Bodnar
4,922,667 A * 5/1990 Kobori ..... E02D 27/34 52/167.2
5,271,197 A * 12/1993 Uno ..... E04H 9/02 52/167.1
5,519,977 A 5/1996 Callahan et al.
5,527,625 A 6/1996 Bodnar
5,533,307 A 7/1996 Tsai
5,595,040 A 1/1997 Chen
5,630,298 A 5/1997 Tsai
5,664,380 A 9/1997 Hsueh et al.
5,749,256 A 5/1998 Bodnar
6,012,256 A 1/2000 Aschheim
6,042,094 A * 3/2000 Lee ..... E04H 9/021 267/150
6,138,427 A 10/2000 Houghton
6,199,336 B1 3/2001 Poliquin et al.
6,301,854 B1 10/2001 Daudet et al.
6,412,237 B1 7/2002 Sahai
6,681,538 B1 1/2004 Sarkisian
6,708,459 B2 3/2004 Bodnar
6,719,481 B2 4/2004 Hoffman et al.
6,739,562 B2 5/2004 Rice et al.
7,293,939 B2 * 11/2007 Abbott ..... B63B 35/4413 114/265
7,299,593 B1 11/2007 diGirolamo et al.
7,712,266 B2 * 5/2010 Sarkisian ..... E04H 9/02 52/167.1
7,739,850 B2 6/2010 Daudet et al.
7,788,878 B1 9/2010 diGirolamo et al.
7,797,886 B2 * 9/2010 Su ..... E04H 9/02 248/632
7,856,765 B1 * 12/2010 Su ..... E04H 9/02 248/632
7,874,120 B2 1/2011 Ohata
8,863,477 B2 10/2014 Stal et al.
2003/0221379 A1 * 12/2003 Oliver ..... E04B 1/34352 52/167.1
2004/0045253 A1 * 3/2004 Russell ..... E01D 21/08 52/745.11
2004/0107654 A1 * 6/2004 Powell ..... E04H 9/02 52/167.3
2005/0126105 A1 6/2005 Leek
2011/0308190 A1 12/2011 Pryor
2015/0101269 A1 * 4/2015 Moreno ..... E01D 19/04 52/167.5
2016/0298352 A1 * 10/2016 Agha Beigi ..... E04H 9/021
2016/0319499 A1 * 11/2016 Annan ..... E01D 19/00

OTHER PUBLICATIONS

The Open Civil Engineering Journal, Development of a Seismic Design Apprach for Infill Walls Equipped with Structural Fuse, Mohammad Aliaari and Ali M. Memari, Oct. 28, 2012, 6, pp. 249-263.
University of Hawaii College of Engineering, Department of Civil and Environment Engineering, Connector Development for Hybrid Masonry Seismic Structural Systems Research Report UHM/CEE/11-03 by Seth R. Goodnight, Gaur P. Johnson, and Ian N. Robertson, May 2011.
University of Hawaii College of Engineering, Department of Civil and Environment Engineering, Verification of Fuse Connector Performance for Hybrid Masonry Seismic Structural Systems Research report UHM/CEE/12-05 by Steven Mitsuyuki and Ian N. Robertson, May 2012.
University of Hawaii College of Engineering, Department of Civil and Environment Engineering, Hybrid Masonry Connector Development Phase II Research Report UHM/CEE/11-04 by Reef Ozaki-Train, Gaur Johnson, and Ian N. Robertson, Dec. 2011.
China/USA Symposium for the Advancement of Earthquake Sciences and Hazard Mitigation Practices, Current Technologies and Future Research Trends for Seismic Hazard Mitigation of Critical and Important Building Construction by Ian N. Robertson, Ph.D., S.E.[1], Feb. 6, 2017, pp. 1-8.
2016 SEAOC Conventin Proceedings, "Structural Fuse" Connection Providing Ductility and Hysteric Energy Dissipation with Easily Replaceable Elements to Reduce Earthquake Damage and Recovery Time by Thor Matteson, SE, Thor Matteson Engineering, Berkeley, CA, pp. 1-20.
Matteson, Thor; "Soft Story Retrofits for the Real World: Contilevered Column Modifications for Increased Ductility and Redundancy;" SEAOC 2014 83rd Annual Convention Proceedings, Sep. 2014; pp. 285-299; Structural Engineers Association of California; Sacremento, California.

* cited by examiner

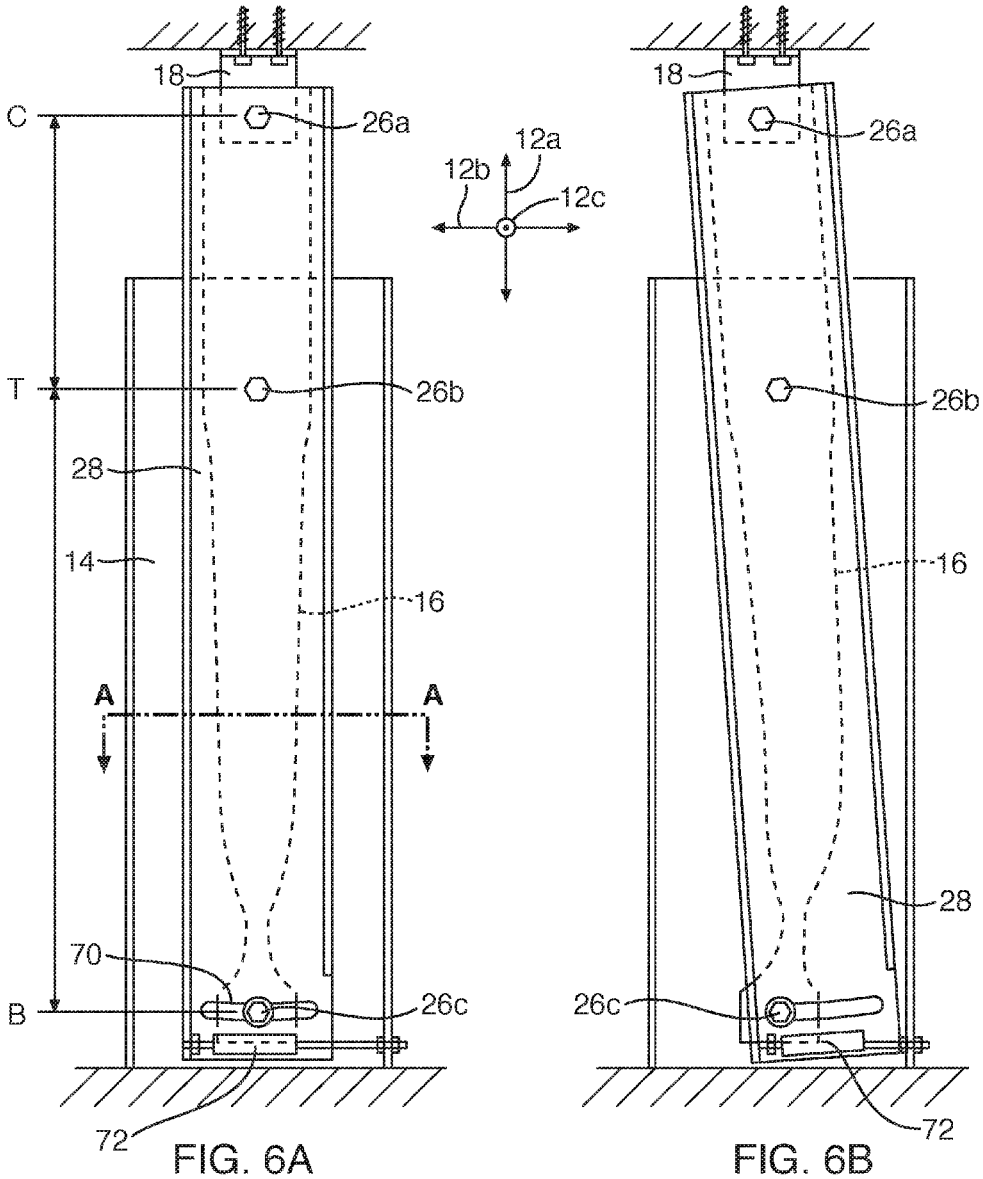
FIG. 6A
FIG. 6B
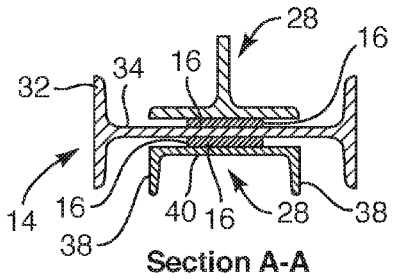
FIG. 6C

FAIL-SOFT, GRACEFUL DEGRADATION, STRUCTURAL FUSE APPARATUS AND METHOD

RELATED APPLICATIONS

This application claims the benefit of U.S. Provisional Patent Application Ser. No. 62/287,985, filed Jan. 28, 2016 and claims the benefit of U.S. Provisional Patent Application Ser. No. 62/397,412 , filed Sep. 21, 2016. This application is a continuation in part application of U.S. patent application Ser. No. 15/226,058, filed Aug. 2, 2016, which is a divisional application of U.S. patent application Ser. No. 14/607,680, filed Jan. 28, 2015, issued Sep. 13, 2016 as U.S. Pat. No. 9,441,360, which claims the benefit of U.S. Provisional Patent Application Ser. No. 61/965,339 filed Jan. 28, 2014.

All the foregoing references are hereby incorporated herein by reference.

BACKGROUND

Field of the Invention

This invention relates to structures for resisting seismic loading of structures and, more particularly, to novel systems and methods for retrofitting structures to increase seismic resistance.

Background Art

Seismic retrofitting of "soft, weak, or open front" (SWOF) buildings presents tactical challenges for engineers. Utilities and other obstructions often make moment-resisting frames difficult to install. The most viable retrofit component is often a cantilevered column with an appropriate new foundation.

The SEAOC (Structural Engineers Association of California) Blue Book suggests strategies that rationalize designing cantilevered columns using the R factor for the overall building. Plywood shear walls are typically used as the lateral force resisting system in SWOF buildings. Using the R factor for plywood shear walls instead of R for cantilevered column systems reduces seismic design forces, thus reducing construction costs. However, building officials may not accept the Blue Book rationale; furthermore, designers may wish to increase the ductility of cantilevered columns.

Seismic retrofitting is particularly difficult in established urban areas, such as San Francisco. Many building lots in San Francisco are very narrow, providing limited room for seismic retrofitting structures, requiring cantilevered columns or moment-resisting frames. Likewise, the front of almost all mid-block buildings includes a garage door, main entry door or stairwell, and a door to a service alley. Some buildings have two stairways; some have two garage doors; in some neighborhoods the garage door is recessed inward several feet from the front wall, and the service alley entrance opens from the wall on one side of the recess. Hardly any buildings have more than four feet of unobstructed wall length available for installing shear panels.

Near the front of almost all buildings in San Francisco there are multiple gas and electric meters, either in the garage or service alley. Water service is usually not metered separately, so a single water supply line is typical. In some buildings, the waste plumbing stack from stories passes next to the garage door. Relocation of such structures is extremely expensive. Other obstructions to seismic retrofitting include fire-sprinkler lines, water heater flues and HVAC ducts. Often the garage door hugs the foundation or side wall of the garage and no space is left for vertical members of a moment-resisting frame. Owners of buildings affected by the mandatory soft story retrofit ordinance must often relocate utilities, at substantial added cost, to allow installation of steel frames. For owners who hope to strengthen their buildings voluntarily, the added costs may simply cause them to drop their retrofit desires altogether.

The apparatus and methods disclosed herein provide an improved approach to seismic retrofitting where space is very limited.

BRIEF SUMMARY OF THE INVENTION

In view of the foregoing, in accordance with the invention as embodied and broadly described herein, a method and apparatus are disclosed in one embodiment of the present invention as including a column defining a first column end and a second column end offset from one another along the vertical direction. A structural fuse defines a first attachment point, a second attachment point, and a third attachment point, the second attachment point being positioned between the first and third attachment points.

The structural fuse is pivotally secured to the column at the second and third attachment points having the first attachment point extending beyond the first column end. The structural fuse is configured to yield in response to a load in a horizontal direction perpendicular to the vertical direction and applied at the first attachment point that is insufficient to cause yielding of the column. The third attachment point may a slot having a long dimension oriented in the vertical direction, the structural fuse being pinned to the column through the slot.

The apparatus includes a building defining a superstructure offset from a ground plane, the first attachment point being secured to the superstructure and the column being rigidly anchored to the ground plane. The structural fuse and column are effective to provide a seismic response factor of at least 6.5 for the building.

The apparatus may include a retention plate, a portion of the structural fuse between the second and third attachment points being sandwiched between the retention plate and the column. In some embodiments, the retention plate is pivotally mounted to the column coaxially at the second attachment point. The retention may define an arcuate slot, the third attachment point being secured to the column by a pin positioned within the arcuate slot.

In some embodiments, the column is an I beam defining first and second flanges and a web extending between the first and second flanges, the second and third attachment points being pivotally secured to the web.

In some embodiments, a first separation between the first and second attachment points is greater than a second separation between the second and third attachment points.

In some or all embodiments, the third attachment point is a slot having a long dimension oriented parallel to the vertical direction.

In some embodiments, the structural fuse has an increasing width with distance from the third attachment point toward the second attachment point. The increasing width with distance from the third attachment point toward the second attachment point may be effective to cause the structural fuse to yield substantially simultaneously along a length of the structural fuse between the second and third attachment points. In some embodiments, the width increases with the distance from the third attachment point toward the second attachment point proportionally to a square root of the distance.

A corresponding method of installation is also disclosed and claimed.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 6A is a front view of an alternative embodiment of the retrofitting structure in accordance with an embodiment of the present invention;

FIG. 6B is a front view of the embodiment of FIG. 6A showing yield in in response to a load;

FIG. 6C is a top cross-sectional view of the retrofitting structure of FIG. 6A in accordance with an embodiment of the present invention;

DETAILED DESCRIPTION OF THE PREFERRED EMBODIMENTS

Figure 1A:
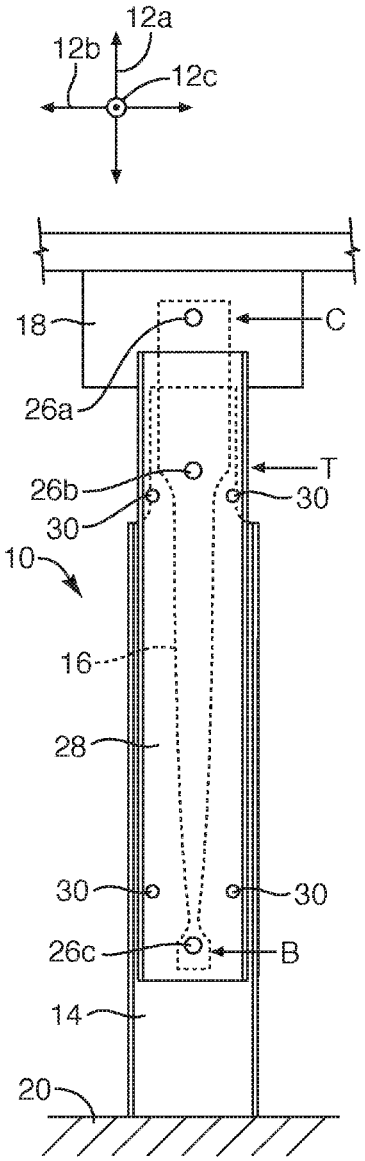
FIG. 1A is a front view of a retrofitting structure in accordance with an embodiment of the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1A to 1E, a seismic retrofitting structure 10 may be understood with respect to a vertical direction 12*a* parallel to the force of gravity, a lateral direction 12*b* perpendicular to the vertical direction 12*a*, and a longitudinal direction 12*c* perpendicular to the directions 12*a*, 12*b*. The retrofitting structure 10 is designed to resist loading in the lateral direction 12*b* due to seismic forces. The retrofitting structure 10 may also cooperate with structures of a building to support forces in the vertical direction or may be unloaded in the vertical direction. In some embodiments, even if loaded, support provided by the seismic retrofitting structure 10 may not be required to support the structure.

The retrofitting structure 10 includes a column 14 having a long dimension thereof oriented parallel to the vertical direction 12*a*. One or more structural fuse 16 define attachment points at the top T and bottom B of an active region and an attachment point C above point T, the portion between points C and T referred to herein as the extension. Points T and B are pivotally fastened to the column 14 and point C is pivotally fastened to the superstructure of the building in which the retrofitting structure 10 is installed. In the embodiments disclosed herein a loading structure 18 is fastened to the superstructure and defines an attachment point for the structural fuse 16. In the illustrated embodiment the loading structure 18 has a T-shaped cross section in the lateral direction 12*b*, with the structural fuse being pinned to a vertically downward extending flange of the loading structure 18.

A bottom portion of the column 14 is fastened to the ground 20, such as by being placed in concrete, bolted to a frame member that itself is fastened to concrete, or by some other means that fixes the base of the column 14 with respect to directions 12*b* and 12*c*. In particular, the fixing of the column 14 to the ground 20 is such that it resists rotation of the column 14 in a plane parallel to directions 12*a*, 12*b*.

The top end of the column 14 may be structurally mounted to the loading structure 18 exclusively by the structural fuses 16. However, other structures such as drywall or non-structural framing may be positioned around the column 14 and loading structure 18, but may be insufficient to substantially alter the function of the retrofitting structure 10. The structural fuses 16 may therefore extend vertically above the top end of the column 14 in order to mount to the loading structure 18 without the column 14 interfering with the loading structure 18.

Figure 1B:
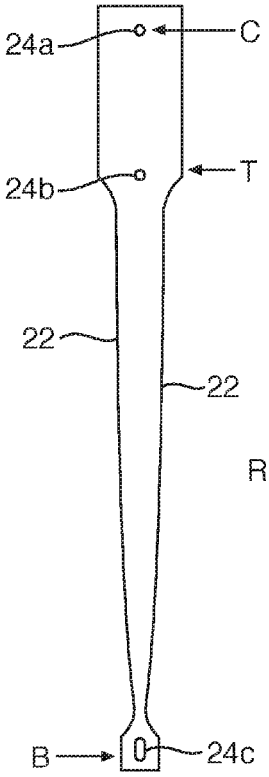
FIG. 1B is a front view of a structural fuse in accordance with an embodiment of the present invention.
Figure 1C:
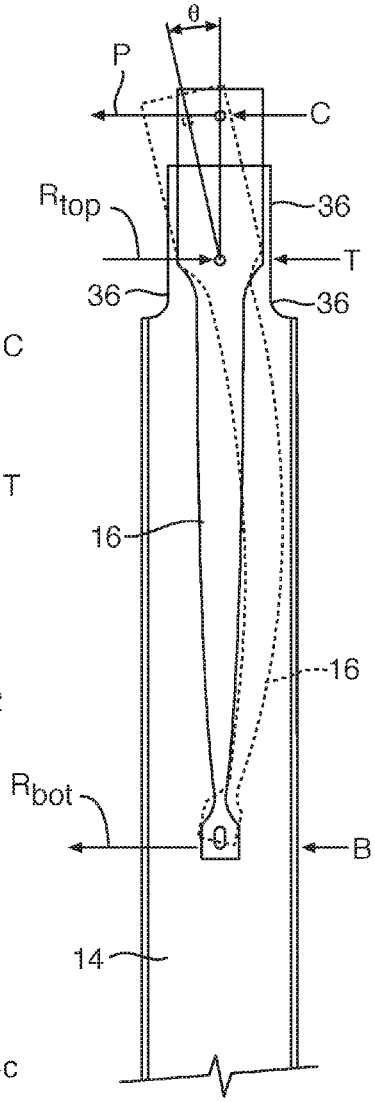
FIG. 1C is a front view of a retrofitting structure showing deformation of the structural fuse in accordance with an embodiment of the present invention.

Referring specifically to FIG. 1C, in operation, a load P including a component in the lateral direction 12*b* is applied to the structural fuses 16. The structural fuses 16 are pinned at points T and B. Fixing of the column 14 with respect to the ground 20 results in reaction forces $R_{top}$ and $R_{bot}$ being exerted on the structural fuses 16 in response to the load P.

The combinations of forces P, $R_{top}$, and $R_{bot}$ result in bending of the structural fuses 16 as shown by the dotted representation of the structural fuses 16 in FIG. 1C. In some embodiments, the structural fuses 16 and column 14 are sized and shaped such that the active region of the structural fuses 16 between points T and B will yield whereas the column 14 experiences only elastic deformation for the same load. The edges 22 (FIG. 1B) of the structural fuses 16 in the active region may be contoured such that yielding of the structural fuses 16 occurs along substantially the entire active region substantially simultaneously. For example, substantially simultaneous yielding along the active region may include yielding occurring within 5% of a loading P for which yielding first occurs at any point along the active region. Likewise, yielding along substantially the entire active region may include yielding along 85%, preferably 90%, and more preferably 95% of the active region. It may be advantageous for full yielding to propagate from the region of the structural fuse closest to Point B toward Point T.

In some embodiments, this approximately simultaneous yielding is achieved by having width between edges 22 in the lateral direction 12*b* increasing with distance from point B moving to point T. The separation of edges 22 may increase according to a function having at least one term equal to Sqrt(y), where y is a distance from point B along the active region.

In the illustrated embodiment, the structural fuses 16 are fastened to the column 14 by means of apertures 24*a*, 24*b*, 24*c* at points C, T, and B, respectively. Bolts 26*a*, 26*b*, 26*c* pass through apertures 24*a*, 24*b*, 24*c* and through the column 14 in order to fasten the structural fuses 16 to the column 14 and constrain rotation about points C, T, and B as the structural fuses bend and deform.

The bending of the structural fuses 16 may result in shortening of the span BT as it becomes the chord length of the arcuate deformed structural fuse 16 between points B and T. Accordingly, the aperture 24*c* may be embodied as a slot having a long dimension thereof oriented in the vertical direction 12*a* when the structural fuses 16 are undeformed. Accordingly, when deformed as shown in FIG. 1C, the ends of the structural fuses containing aperatures 24*c* may shift upwardly, as shown by the dotted representation of the structural fuses 16, without causing an axial tensile load on the structural fuses 16. In this manner, predictable bending along the length of the active region may be achieved. The length of the slot of aperture 24*c* depends on the length of the active region and the smallest radius the active region of the structural fuses will form.

In some embodiments, buckling of the structural fuses 16, i.e. any movement out of the plane of directions 12*a*, 12*b* is prevented or reduced by retention plates 28 that also fasten to the column 14 having the structural fuses 16 sandwiched between the column 14 and the retention plates 28. The retention plates 28 may be fastened to the column 14 to achieve a certain amount of clamping force in order to prevent buckling of the structural fuses 16 and may exert a significant frictional force on the structural fuse 16 and may therefore operate as a damping force. In some embodiments the frictional force is undesirable.

Experiments conducted by the inventor have shown that localized buckling of the structural fuses 16 leads to rapid fatigue cracking and failure. The retention plate 28 may therefore be selected to have adequate strength and stiffness to keep the structural fuses 16 from buckling along the edge 22 that is currently in compression. However, if buckling is limited to small amplitude, then failure may occur elsewhere.

In some embodiments, the retention plates 28 are secured to the column 14 by the same bolts 26*b*, 26*c* that constrain rotation of the structural fuses 16. In some embodiments, the retention plates 28 are additionally or alternatively fastened to the column 14 by fasteners 30 positioned such that they do not interfere with the bending of the structural fuses 16. As shown, this may include positioning the fasteners 30 vertically near points T and B and laterally offset therefrom such that for the entire range of movement of the structural fuses 16, the structural fuses 16 will not contact the fasteners 30.

In the embodiment of FIG. 1A, there are four fasteners 30 distributed as shown. In some embodiments, the fasteners 30 may pass through spacers positioned between the retention plates 28 and the column 14. In some embodiments, one or more thin shims (e.g. 0.03 inch) may be positioned on top of the spacers, which facilitates free movement of the structural fuses 16. The fasteners 30 further help secure the retention plates 28 in the case of failure of the structural fuses between points B and T, which may provide a degree of protection depending on the geometry of the components and expected deformed shape of the structural fuses 16.

Figure 1D:
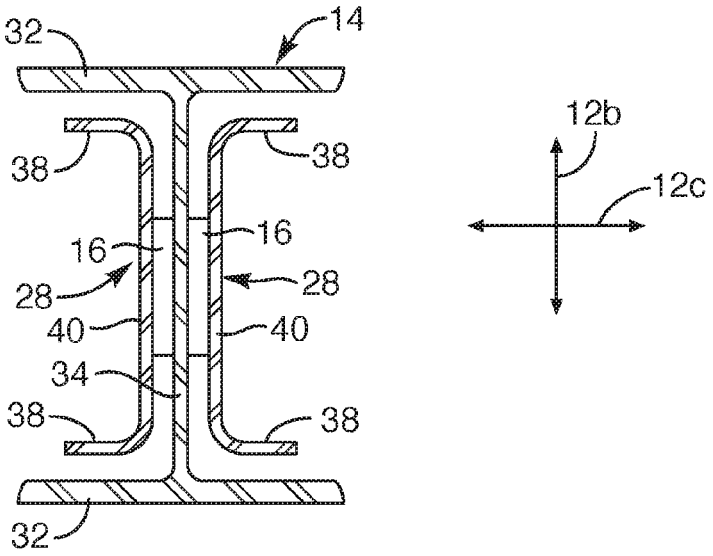
FIG. 1D is a top cross-sectional view of the retrofitting structure in accordance with an embodiment of the present invention.

Referring specifically to FIGS. 1C and 1D, the column 14 may be an I beam including flanges 32 projecting in the longitudinal direction 12*c* from a web 34. As shown in FIG. 1C, the flanges 34 may be cutaway in an end region 36 of the column 14. In the illustrated embodiment, the flange-less region 36 extends from a top end of the column 14 to at or below point C. In this manner, rotation of the structural fuse 16 extensions between points C and T is not inhibited by the flanges 32. The lateral separation of the flanges 32 and the lateral width of the structural fuses 16 in the active region may be selected such that a desired degree of yielding occurs before the structural fuses 16 impinge on the flanges 32.

The retention plates 28 may likewise include flanges 38 extending in the longitudinal direction 12*c* and a web 40 extending between the flanges 38 in the lateral direction 12*b*. The flanges 38 increase the stiffness of the retention plates 28 and enable them to further reduce buckling of the structural fuses 16. In some embodiments, the retention plates 28 may be embodied as a length of HSS (hollow structural section) cut in half lengthwise. A retention plate 28 made of HSS provides for deeper flanges 38 and correspondingly increased stiffness. Another advantage of HSS is the surface finish, which reduces friction. The gentle corner radius and the smoothness of the wall of HSS also causes much less damage to the structural fuses 16 as they slide beneath the retention plates 28.

HSS is available in a variety of sizes and thickness and therefore provides a variety of widths and thickness of the web 40 and height of the flanges 38 in the longitudinal direction 12*c*. This allows designers to choose a width suitable for the particular structural fuses 16 and column 14 that the retention plates 28 needs to match. Thicker HSS sections can prevent out-of-plane deformation of the web 40 that spans between the flanges 38.

As shown in FIG. 1D, the retrofitting structure 10 may include two structural fuses 16 positioned on either side of the web 34 of the I beam. In such embodiments, the retrofitting structure 10 may include two retention plates 28 having the structural fuses 16 and web 34 positioned therebetween. The column 14 may be sized to remain elastic under load that produces full plastic moment in the structural fuse 16 or pair of structural fuses 16, with an appropriate "overstrength" safety factor.

Figure 1E:
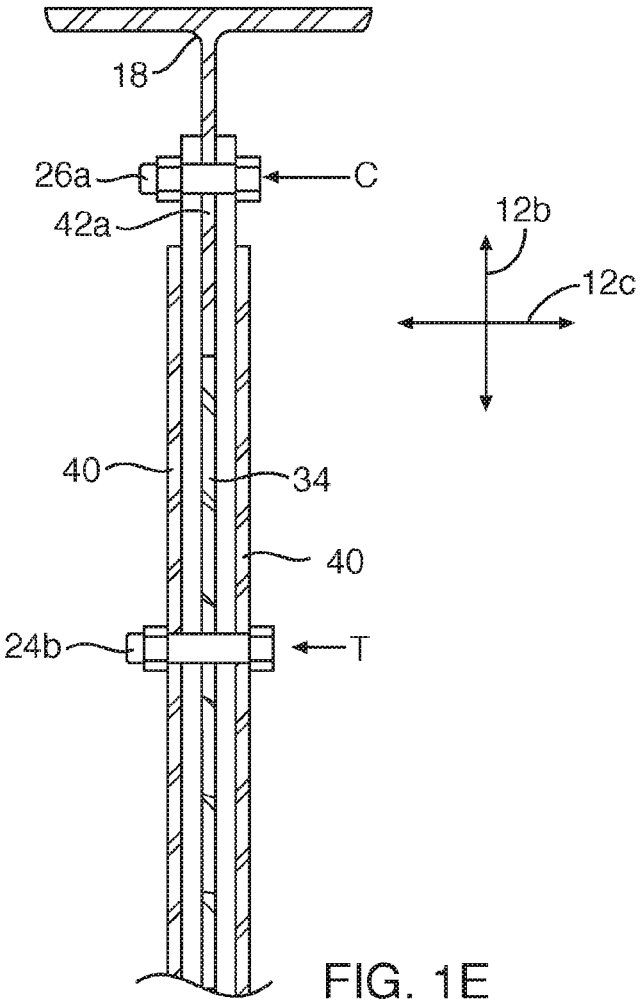
FIG. 1E is a side cross-sectional view of the retrofitting structure in accordance with an embodiment of the present invention.
Figure 1F:
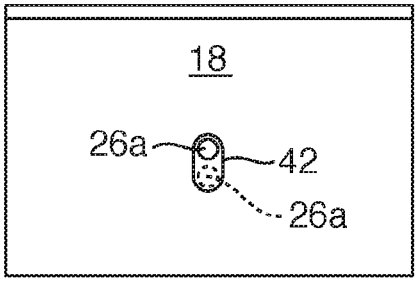
FIG. 1F is a front view of a loading structure in accordance with an embodiment of the present invention.

As shown in FIGS. 1E and 1F, the structural fuses 14 may be fastened to either side of the loading structure 18, such as by a single bolt 26*a*. In some embodiments, bolt 26*a* may pass through a slot 42 in the loading structure 18 having a longer dimension parallel to the vertical direction 12*a* in order to permit arcuate movement of point C about point T in response to the load P. The bolt 26*a* may be tensioned such that rotation of the structural fuse 16 about the bolt 26*a* is permitted.

As Point C moves back and forth it follows an arc of radius CT, with Point T at the center (FIG. 1C). Thus the vertical distance from Point C to Point T decreases with greater horizontal movement of Point C. A vertically-slotted aperture 42 accommodates vertical movement of bolt 26*a* downward, as shown by the dotted representation in FIG. 1F. This may impose a practical limit on the rotation angle, θ, through which the portion of the structural fuse between points T and C, "the upper portion," can rotate.

In experiments conducted by the inventor, the top of the slot 42 enlarged under repeated cyclic loading. This created a key-hole shape, and prevented free movement of the bolt 26*a* at Point C as the loading plate traveled back and forth. Accordingly, the loading structure 18 may have an increased strength or thickness to prevent this deformation. Additionally or alternatively, the loading structure 18 may be positioned to bear against the top of the web 34 so that the loading structure 18 will not be pulled down if the bolt 26*a* snags in the slot 42 as it follows the downward arc during its travel.

Figure 1G:
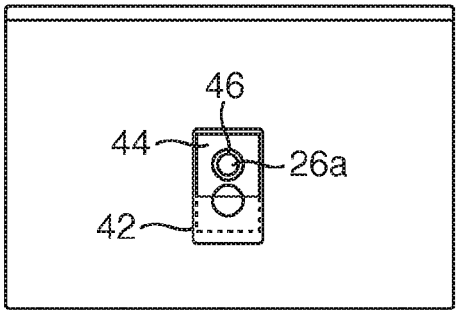
FIG. 1G is a front view of an alternative embodiment of a loading structure in accordance with an embodiment of the present invention.
Figure 1G:
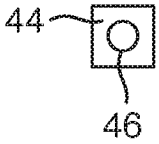

Referring to FIG. 1G, to reduce deformation, a bushing 44 may be positioned within the slot 42, which may be rectangular. The bushing 44 may include an aperture 46 in the bushing 44 for receiving the bolt 26*a*. The bushing 44 has straight vertical edges that engage the slot 42 thereby distributing the load and reducing deformation of the slot 42. The mating surfaces of the bushing 44 with the slot 42 may be lubricated to facilitate sliding.

As is apparent in FIG. 1D, the structural fuse 16 may be a planar member made of a sheet of metal having a uniform thickness (subject to manufacturing tolerances) in longitudinal direction 12*c*. The thickness of the structural fuse 16 in the longitudinal direction 12*c* and the width of the structural fuse 16 in the lateral direction 12*b* are selected to provide desired properties as outlined below. In one embodiment, the structural fuse 16 has a thickness of 3/16 inch.

In the elastic range, stress in the structural fuse between Points T and B is given by:

$$\sigma = R_{bot}(y)/S \quad (1)$$

where y is the distance from Point B as shown, and S is the elastic section modulus of the structural fuse given by:

$$S = td(y)^2/6 \quad (2)$$

where t is the thickness of the structural fuse 16 (parallel to the longitudinal direction 12*c*) and d(y) is the width (parallel to the lateral direction 12*b*) at that distance y from point B along the structural fuse 16 that is under consideration.

For bending stress to be uniform along the active region of the structural fuse 16, S may advantageously increase linearly with distance from Point B. Linear increase in S means that width d(y) must vary with the square root of the distance from Point B, which is reflected in the curving edges 22 of the structural fuse 16. Note that the short arcs near the ends of the active region of the structural fuse 16 merely provide smooth transitions at connection points B and T.

Cyclic loading at Point C causes bending in the structural fuse 16 to alternate between concave to the left and concave to the right. To prevent low-cycle fatigue in the structural fuse 16, the strain should be limited to 20 times the yield strain for the particular material, such as steel, used to form the structural fuse 16 (Uang, 2016). For an expected yield strength $F_y$ of 55 ksi for the structural fuse 16, this gives a limit of about 3.8 percent total strain. Wider structural fuse 16 sections require greater arc radii to limit bending strain, which corresponds to a longer active region. Geometric relations between the structural fuse 16 width and radius influence the length of the active region.

In order to limit torsional movement of the retrofitting system 10, the deflection of the structural fuse 16 should be comparable to the deflection of seismic force resisting system (SFRS) elements along other lines of resistance, e.g. the longitudinal direction 12*c*.

Deflection at Point C for a given angle of rotation θ can be adjusted by varying the distance between points C and T within a reasonable range. However, changing this parameter affects many other parts of the assembly. Calculated elastic deflection for the structural fuse 16 itself may range from 0.1 inch to 0.22 inch for several different configurations. Elastic deflection of the column 14 may be calculated using the classic formula for a cantilevered beam with concentrated load at the free end, where deflection is given as $PL^3/3EI$, where P is the lateral load, L is the length of the column 14 above the ground 20, E is the elastic modulus of the column 14, and I is the moment of inertia of the column 14. The design example given below illustrates the relationship between the lengths $\overline{CT}$ and $\overline{TB}$, the initial stiffness, practical drift limit, and load capacity.

The need for clamping to prevent buckling of the structural fuse 16 may be balanced with respect to friction that results from increased clamping force. Friction against a lower portion (closer to point B) of the structural fuse 16 will increase the moment closer to the top of the active region. This will focus the yielding in the upper region (closer to point T), where the width-to-thickness ratio is greatest. When initial yielding occurs predominantly (or only) in the upper region, it may result in early local buckling and failure.

In order to reduce friction, the surfaces of the web 40 of the retention plate 28 and/or the web 34 of the column 14 in contact with the structural fuse 16 may be smooth. In some embodiments, these surfaces may be polished or treated with lubricants to reduce friction. The lubricant used is preferably very viscous and chemically stable inasmuch as the retrofitting structure may not be needed for decades after the assembly is installed but would need to still function. Other methods to reduce friction include sandwiching a thin layer (or layers) of plastic between the structural fuses 16, column 14 and retention plate 18 or coating components with slippery material, or a combination of any of these approaches. Coatings or sheets may preferably have high compressive strength comparable to the steel components.

The edges of the retention plate 28 may be rounded, as shown in FIG. 1D, to avoid gouging of the structural fuse 16, particularly when localized buckling of the structural fuse occurs. The surfaces of the retention plate 28 and web 34 in contact with the structural fuse 16 are preferably flat rather than concave or convex inasmuch as this may permit buckling.

In order to account for friction, the contours of the edges 22 may be adjusted from the Sqrt(y) profile mentioned above. For example, the width of the active region of the structural fuse 16 that will theoretically lead to simultaneous yielding along the length of the active region may be multiplied by a "capacity increase factor" (CIF) to provide an increased section modulus at any particular location along the structural fuse. Examples of CIF values include:

1. A CIF of 1.5 at point T and 1.0 at point B, varying linearly between points T and B.
2. A CIF of 1.5 at point T, 1.15 at a midpoint between points T and B, and 1.0 at point B, with the CIF varied linearly in the two halves of the active region.
3. A CIF of 1.15 at top and 1.0 at bottom, varying linearly from top to bottom.
4. Varying the CIF parabolically from bottom to top, or a combination of linear and parabolic variance of the CIF.

Testing indicates that cases 1 and 2 provide particularly good distribution of yielding, especially as compared to structural fuses 16 in the absence of use of the CIF. When yielding first occurs at the 'weakest' point along structural fuses 16 with an augmented width according to the CIF, the extreme fiber bending stress at a particular point along the active region is equal to $F_y$ divided by the CIF at the point under consideration. Contemporary steel can provide impressive ductility when treated properly. For the CIF of type 2, structural fuses 16 survived 10 cycles of 2.5 inches to 3 inches before failure. Note that friction is independent of the thickness of the structural fuse 16. Accordingly, as the thickness of the structural fuse 16 is increased, it may be found that the CIF could be reduced.

Figure 2:
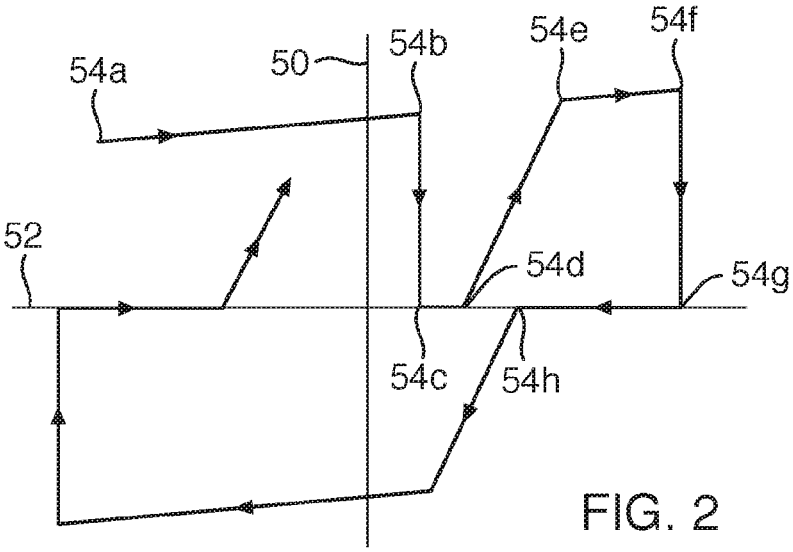
FIG. 2 is a hysteresis diagram of load versus displacement for the retrofitting structure in accordance with an embodiment of the present invention.

Referring to FIG. 2, if the structural fuse 16 breaks close to point B, it may still be able to resist peak loads because the long tail extending from point T is captured between the flanges 32 of the column 14. When the load reverses there is some free travel as the tail swings across the width of the web 34 until it contacts the inside face of the opposite flange 32. FIG. 2 shows a simplified representation of what the hysteresis plot would look like at the time the structural fuse fractures and during subsequent cycles.

In the plot of FIG. 2, the vertical axis 50 represents load and the horizontal axis 52 represents displacement in the lateral direction 12*b*. Point 54*a* shows displacement and loading at some point prior to failure. Point 54*b* is the point where fracture occurs, which is followed by the load dropping to zero at point 54*c*. At point 54*d*, the tail of the structural fuse 16 swings into contact with the flange 32 of the column 14. Elastic deformation occurs until point 54*e* where yielding commences again. At point 54*f*, loading is reversed, and loading then reduces to zero at point 54*g* as the tail of the structural fuse 16 swings across the web 34 of the column 14. At point 54*h*, yielding behavior resumes. The cycle of points 54*f* through 54*h* may repeat, without points 54*b* through 54*e*.

General Design Approach

The manner in which the dimensions of the structural fuse 16 and column 14 are selected for a given application will now be described. The retrofitting structure 10 would typically be paired with more conventional structural elements and systems. This section discusses some of the interactions between existing building code sections and design considerations for the retrofitting structure 10.

Comparison to Conventional Structural Systems

The combination of cantilevered column 14 and structural fuse 16 does not match any conventional structural system. Choosing seismic design parameters (overstrength, deflection amplification, and response factors) leaves an enormous range of possibilities: for example, R is 1.25 for ordinary cantilevered columns, and 8 for special moment frames. The retrofitting structure 10 has traits of both. Guidance may be found in the document FEMA (Federal Emergency Management Agency) recently developed: "*Quantification of Building Seismic Performance Factors: Component Equivalency Methodology*" FEMA P-795 (FEMA, 2011), which is hereby incorporated herein by reference.

FEMA P-795 details the analysis, testing, and conceptual comparisons considered acceptable to determine whether a particular component can be substituted into a particular conventional structural system. Four factors are considered in determining equivalency:

Deformation capacity (ultimate deformation)

Strength (ratio of measured ultimate strength to design strength)

Initial stiffness (ratio of measured initial stiffness to design stiffness)

Effective ductility (ratio of ultimate deformation to effective yield deformation)

Seismic Design Parameters

The retrofitting structure 10 is particularly suited for bracing wood-framed buildings. For substitution into wood-framed buildings braced with WSP shear walls, the structural fuse 16 needs to have similar initial stiffness, ductility, peak strength, post-yield strength, and ultimate deformation capacity.

Experiments conducted by the inventor indicate that performance matching that of WSP shear walls can be achieved through design choices for the retrofitting structure 10. Accordingly, the retrofitting structure 10 could be substituted into wood structural panel ("WSP") shear wall systems using seismic response factor R=6.5, overstrength factor $\Omega_0=3$, and deflection amplification factor $C_d=4$.

Linear Static Design Approach

The retrofitting structure 10 is particularly suited for wood-framed buildings of four stories or less, which would typically be analyzed using the linear static design approach in ASCE-7 Section 12.8, Equivalent Lateral Force Procedure (ELF Procedure).

Seismic Force Calculations

Horizontal force on the assembled structural fuses 16 and column 14 would typically be determined based on the following:

R=6.5

$\rho$=1.0 or 1.3, as appropriate under ASCE-7 requirements (redundancy factor; penalty for lack of redundant elements)

A detailed design example will be presented in following sections.

Strength of Column 14

The column 14 may advantageously remain in the elastic range (with an appropriate safety factor) when the structural fuse 16 reaches full plastic moment. American Institute of Steel Construction ("AISC") Seismic Provisions require using the "expected material strength," $R_y$ and $F_y$ (where $F_y$ is the specified steel yield strength, and $R_y$ is the expected strength ratio given in AISC 341 Table A3.1) for designing adjoining members. $R_y$ varies from 1.1 to 1.5 for plate or bar stock, depending on the type of steel used. The preceding reflects the exception given in ASCE 7 that caps forces increased by the overstrength factor:

ASCE-7, Section 12.4.3.1, Horizontal Seismic Load Effect with Overstrength Factor. Exception: The value of $E_{mh}$ need not exceed the maximum force that can develop in the element as determined by a rational plastic mechanism analysis . . .

The structural fuses 14 may be designed such that the applied load P induces yielding. Since the plastic modulus of a rectangular section is 1.5 times the elastic section modulus, a load of 1.5 P is required to bring the structural fuses 16 into fully plastic bending. Applying $R_y$ on top of this we get a factored value of $P_{(col)}$ for designing the column 14 as:

$$P_{(col)}=1.5(P)\ R_y, \tag{3}$$

where $P_{(col)}$ is the force for which the column 14 should remain elastic, P is the force determined through the ELF Procedure, and $R_y$ is an expected strength ratio. Note that for calculating the maximum moment in the column 14 we need to calculate the moment M in the column as if $P_{(col)}$ is applied at point C, which is above the top of the column 14.

Load Calculations Related to Story Drift

Drift limits are given in ASCE-7 Table 12.12.1 and depend on risk category and design of non-structural elements to accommodate drift. For a typical unfinished lower level garage, a drift limit of 0.025h is appropriate, where h is the height from garage floor to first floor sheathing. Two important provisions in ASCE-7 apply to determining story drift, as follows:

Section 12.3.4.1, Item 2: The redundancy factor ρ is permitted to be taken as 1.0 for drift calculations . . .

Section 12.8.6: If allowable stress design is used, strength-level forces must be used in determining drift . . .

(e.g., for drift calculations, ASD forces must be increased by 1/[0.7]). Elastic deflection is multiplied by $C_d$ for the applicable system. Note that strength level forces do not include the additional factors used to assure the column does not yield when the structural fuses reach their full plastic moment.

Deflection Amplification Factor

Drift includes contributions from deformation of both the column and the structural fuses. Typically the combined elastic deformation at design load would be determined and increased by the deflection amplification factor, $C_d$. The amplified deflection must be less than the allowable story drift.

The $C_d$ factor is intended to give a realistic estimate of actual deflections when yielding occurs at design level forces. $C_d$ is described as an "uncertainty factor." The design approach described in this application ensures that the structural fuses 16 are the only elements that yield in the retrofitting structure 10. To maintain efficiency of design one could argue that $C_d$ should only apply to the structural fuses' 16 contribution to total deflection. Cantilevered column deflection of $PL^3/3EI$ has been accepted for over a century with no uncertainty.

Applying $C_d$ to the entire retrofitting structure 10 can increase the required stiffness of the column 14 substantially, resulting in structural sections two or three incremental sizes heavier than would be required to meet only the strength requirements. Analyses of structural fuses 16 conducted by the inventor indicate that a peak elastic deformation in the range of 0.10 to 0.22 inches is likely achievable.

Peak load capacity may be determined by obtaining load-deformation curves well beyond peak elastic load, into the yielding range, and beyond peak load capacity. This understanding of peak load capacity enables determination of how to apply $C_d$.

Design Example (ASD)

The retrofitting structure 10 fills the need for bracing soft-story buildings in cities such as San Francisco. The City of San Francisco has mandated retrofitting a few thousand soft-story buildings that have a typical maximum size of 25 feet wide by 65 to 80 feet deep. Very few of these have more than three levels above the soft story.

Light wells, inner stairs and decks, etc. usually change the building perimeter from a simple rectangle to a "dumb-bell" or "hourglass" shape. Sometimes the center portion is so narrow that the floor diaphragm will not span from front to back of the building if seismic force resisting elements are located only at the ends.

The following design example presents a structural fuse 16 and column 14 combination meant to brace a three-story wood-framed building with a tributary depth of 35 feet (one-half of an assumed 70-foot deep building). Building material weights used are typical. This example assumes a garage ceiling height of 8 feet.

Seismic Weight

Building weight is determined as 165 pounds per square foot of ground level footprint area. Assuming light wells of 5 feet by 20 feet on both sides of the building we subtract 200 square feet from the gross building area. This gives a total seismic weight, W, of:

$$W=[(25'\times 70')-2(5')(20')](0.165\ \text{ksf})=256\text{k}$$

Seismic Force Tributary to Structural Fuses & Column

Using the Equivalent Lateral Force Procedure given in ASCE-7, Section 12.8, we find the tributary force at the open front of the building as follows:

$$V=C_S W. \tag{4}$$

The seismic coefficient, $C_S$, is determined as follows:

$$C_S=S_{DS}/(R/I_e). \tag{5}$$

Equation (5) is evaluated using the following values: $S_{DS}$=1.1 (hypothetical site in central San Francisco), R=6.5 (assuming properties of WSP shear walls), and $I_e$=1.0. The resulting value is $C_S$=1.1/6.5, or $C_S$=0.169

Our tributary V according to (4) is then: V=0.169 (256k/2)=21.7.

There are three more adjustments to make. First, we need to multiply by the redundancy factor ρ of 1.3 since we are designing an element intended to resist 50% of the story shear. Next, the California Existing Building Code allows multiplying V by 0.75 for seismic retrofits. Finally we multiply by 0.7 since we are using allowable stress design. Using the notation from FIG. 1C, the load at the top of the column is denoted as P:

$$P=21.7(1.3)(0.75)(0.7)=14.8\text{k}.$$

Mounting Column Initial Design

As discussed earlier, the column 14 is preferably designed to resist a moment developed by a force causing full yielding of the structural fuses 16, multiplied by $R_y$. For the structural fuses 16 we use ASTM A572 Grade 50 steel. The corresponding $R_y$ per AISC 341 is 1.1. In the absence of complete testing, it is appropriate to increase $R_y$ to 1.25 or more. In this example we will use 1.3 for $R_y$.

Thus our column 14 is designed based on a magnified load, $P_{(col)}$ of:

$$P_{(col)}=1.5P\ (1.3)=1.95\ P=28.9\text{k}.$$

One of the major cost savings in using the structural fuses 16 as presented here is that no welding is needed. To avoid a welded base plate, we embed the column 14 in a reinforced concrete footing designed to resist the forces described herein as known in the art of concrete construction.

Design of the column 14 is based on the following: the workpoint for the bottom of the column is the midpoint of a 30 inch deep grade beam, the grade beam is set under a 3 inch thick floor slab, and the ceiling height is 8 feet.

Assuming we connect to the underside of the first floor framing at ceiling level, the design column height is 1.25+0.25+8 feet, or H=9.5 feet.

The design moment is:

$$M=28.9k\ (9.5\ ft)=274\ ft.\text{-}k$$

The required section modulus, S, and allowable stress increase of 1.2 for transient loading provides:

$$S_{min}=274(12)/0.6(50\ ksi)(1.2)=92.0\ in^3.$$

If we limit ourselves to seismically compact sections, we can choose a W10×88, W12×96, or W14×68 steel beams for the column 14. Depending on space available for the column 14 and drift considerations, one of the above may be preferred over the others.

Structural Fuse Geometry

FIG. 1B shows a schematic of the structural fuse 16 referred to initially in this example. The "active region" between points B and T is the portion that we design to yield; the "extension" (between points C and T) connects to the structure above. The relationship between these will become clear in the example. Several properties of the structural fuse 16 can be varied to affect structural fuse 16 performance. These include:

material thickness (in longitudinal direction 12*c*), link width (in lateral direction 12*b*), active length (separation between points B and T), extension length (distance between points C and T), and yield strength of the steel used to make the structural fuse. These all interact and affect initial stiffness, ultimate deflection before the arced structural fuse 16 contacts the column flanges 32, ductility, etc.

As an initial trial we start with ½ inch thick structural fuses. If we use ½ inch thick plate or bar stock we can determine the required width based on desired stress levels. To reduce the chance of connection holes affecting behavior of the yielding steel we will increase the section modulus within approximately 1.5 inches above the aperture 24*c* and below the aperture 24*b*. The increased width portion above aperture 24*c* and below aperture 24*b* may have smaller or larger length. Accordingly, references to the 1.5 inch distance below may be replaced with this smaller or larger length.

For the tributary load of 14.8k, given the structural fuse 16 having an active region length of 30 inches and an extension length of 10 inches, we determine $R_{top}$ and $R_{bot}$ as 19.7k, and 4.93k, respectively. These reactions are divided between two structural fuses 16 on either side of the column 14 (see FIGS. 1D and 1E).

We want the structural fuse 16 to reach the yield stress at the point 1.5 inch above Point B initially, and for yielding to progress up the link toward Point T.

Using Equation 1 and solving for S we find:

$$S=(R_{bot})(y)/(2\ F_y). \tag{6}$$

Substituting the right-hand expression above into Equation 2 and solving for d we get:

$$d=\sqrt{3R_{bot}(y)/t(F_y)}. \tag{7}$$

Using earlier values we calculate d at the bottom of the active region of the structural fuse (y=1.5 inches) as:

$$d_{bot}=\sqrt{3(4.93k)(1.5in)/(0.5in)(50k/in^2)}=0.94\ inch.$$

For the remainder of the active length we want the stress to diminish as we move from Point B to Point T at any particular load. The stress variation is based on the capacity increase factor (CIF) of the link, where CIF may be a function of y as outlined above:

$$d=\sqrt{3R_{bot}(y)(CIF)/t(F_y)} \tag{8}$$

For the point 1.5 inch below Point T (where y=28.5"), and using a CIF of 1.5 at that point, we substitute the following into Equation 8:

$$d_{top}=\sqrt{3(4.93k)(28.5in)(1.5)/(0.5in)(50k/in^2)}=5.03\ inches.$$

Widths along the active length can be determined with a spreadsheet at desired increments.

Checking Curvature of the Structural Fuse under Load

To assure that the structural fuse 16 does not suffer low-cycle fatigue it may be preferable to limit the strain in the active region to a maximum strain between 5 and 6 percent.

Using similar triangles and assuming "small" deformation, the radius of curvature, $R_C$, of the center line of the structural fuse 16 extending between points B and T has the following relationship to strain, $\epsilon$, and depth of section, d: $R_C=(d/2)/(\epsilon/2)$. Note that we use only half of the strain to determine the radius; the strain will double when cyclic bending reverses the curvature. Thus the radius of curvature reduces to:

$$R_C=d/\epsilon. \tag{9}$$

Ultimate Story Drift versus Extension Length of Structural Fuse

Choosing a "target deflection" for the structural fuse 16 connection point C at peak load requires careful consideration. For buildings braced with WSP shear walls, 4% story drift is widely accepted as the dividing line between a building that can be repaired or one that must be demolished. WSP shear walls reach their peak strength at around 2.5% story drift. Accordingly, a deflection between 3 and 4 percent drift may reasonably be assumed to assure that the structural fuse 16 and column 14 will be the last structural elements to fail in a building braced with WSP shear walls. (Note: the "target deflection" has nothing to do with allowable story drift.)

If we aim for a 3.5 inches deflection of Point C from its neutral position (a story drift of about 3.5% for an 8-foot ceiling height), a 10 inch extension of the structural fuse 16 must rotate 20 degrees about Point T to give this drift (i.e, (10 inches)sin(20°=3.4 inches). For a 20-degree arc, the vertical travel of Point C is 0.63 inch. The vertical slot 42 in the loading structure 18 preferably accommodate at least this much vertical travel. Allowing vertical travel for an even greater distance, e.g. 1.5 inches, should have no ill effect on the system. Note that deflection of the column 14 will contribute to the desired 3.5 inches total deflection.

Initial Geometry Check

We want the structural fuse 16 to have initial stiffness similar to a WSP shear wall, while maintaining strength up to at least the story drift where WSP shear walls reach peak strength. The previous sections gave the relationship between strain and curvature, and a target story drift to match WSP shear walls. We need to confirm that the geometry of the structural fuse 16 will provide the target drift level, while at the same time staying below the level of strain that would lead to low-cycle fatigue.

Bending strain depends on the width of the structural fuse 16 and its curvature. Because the width varies along the structural fuse the curvature will also vary, with the smallest radius near the bottom (Point B). Assuming an average curvature gives an approximation. However, in reality the deformed shape varies significantly. The variations caused by friction or other factors outweigh any perceived accuracy that a careful effort at predicting the actual deformed shape would give. In particular, the unpredictable performance due to friction motivates use of the capacity increase factor (CIF) in order to compensate for this uncertainty.

Assuming that we have a CIF of 1.25 at the midpoint of B and T, we calculate the width of the structural fuse as 3.33 inches. Substituting this width into Equation 9, along with our allowable strain of 5%, we can find the radius of curvature $R_C$:

$$R_C=3.33/0.05=67 \text{ inch.}$$

Figure 3A:
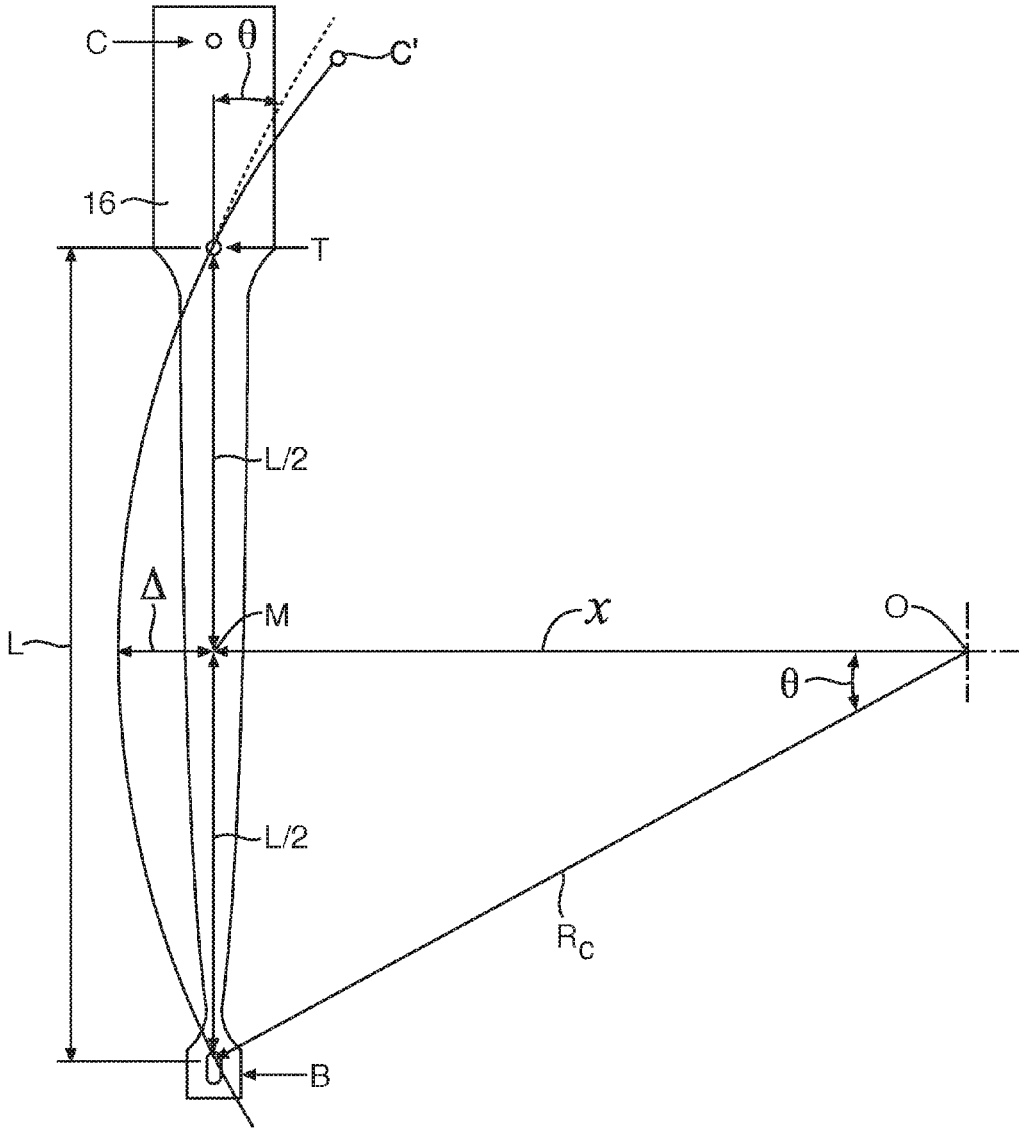
FIG. 3A is a diagram illustrating geometric labels for characterizing yielding of the structural fuse in accordance with an embodiment of the present invention.

Again using simple geometry, we can find relationships between the radius of curvature $R_C$, distance between the pins at Points B and T, and the distance that the centerline of the structural fuse 16 deflects from its neutral position. As shown in FIG. 3A, the active region of the structural fuse 16 will define an arc between points B and C in response to the load P. A chord length L may be defined as the straight line distance between points B and T. A value $\Delta_C$ is defined as the lateral deflection of point C to a new point C' from its neutral position. A value Δ is defined as the lateral deflection of the centerline of the active region of the structural fuse 16 in response to the load P as measured at the midpoint M along the centerline between points B and T.

Figure 3B:
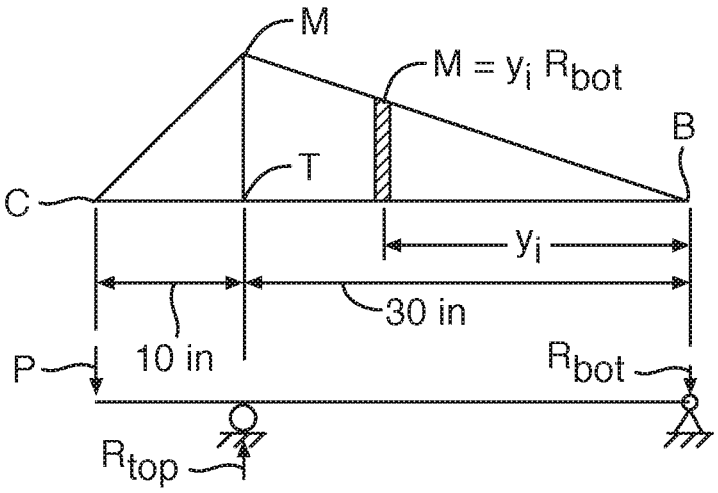
FIG. 3B is a moment area diagram illustrating loading of the structural fuse in accordance with an embodiment of the present invention.

For chord length L between pins at Points B and T, Radius $R_C$, $x+\Delta=R_C$, and with $\overline{MB}$ perpendicular to $\overline{MO}$ (see FIG. 3B) we can solve for the following relationships:

$$\Delta=R_C-\sqrt{R_C^2-L^2/4} \tag{10}$$

$$L=2\sqrt{2(R_C\Delta)-\Delta^2} \tag{11}$$

$$R_C=(\Delta^2+L^2/4)/2\Delta \tag{12}$$

The deformed link must fit between the flanges 32 of the column 14. for improved performance, the structural fuse 16 should not encroach within the width of any fillet at the transition between the flange 32 and web 34. To meet this restriction, d/2 at the midpoint of the active region plus the quantity Δ as calculated using Equation 10 above, preferably does not exceed half the width between any fillet transition between the flange 32 and web 34 of the column 14. Conversely, giving too much room between the structural fuse 16 at its tightest recommended curvature and the inside face of the column flange 32 could allow significantly greater strain at high story drift. Restricting travel of the structural fuses 16 provides a "safety net" for the system.

We can calculate Δ using (10) with the structural fuse length L of 30 inches and the radius we just determined. Thus:

$$\Delta=67-\sqrt{67^2-30^2/4}=1.70 \text{ inches}$$

Now we check clearance between the deformed link and the fillet area of the column 14:

$$\Delta+d/2=1.70+(3.33/2)=3.37 \text{ inches}$$

Using a W14×68 as the column 14, AISC tables show 10.875 inches as the distance between tangent points at the innermost edges of fillets between web 34 and flanges 32 (distance "T" in the AISC tables, hereinafter denoted as $T_k$). Half of $T_k$ is 5.44 inches, which exceeds the 3.37 inches determined above.

Checking Maximum Deflection of Point C

Seismic force is delivered to the system through a pinned connection at Point C, which will move in a circular arc about Point T as shown in FIG. 3A. In some embodiments, the loading pin's travel will be limited to the very top of the arc, thereby reducing vertical components of movement and force. The relative horizontal displacement of Point C from its neutral position depends on the distance between points C and T and the angle that the deformed centerline of the structural fuse 16 forms with a vertical line intersecting point T.

The next step is checking to see if the deformed structural fuses' rotation at Point B will give the 3.5 inch deflection sought in the previous section. If the deflected active region of the structural fuse 16 formed a circular arc between points B and T, and a line tangent to said arc at point T extended to point C', then the angle θ in FIG. 3B would be equal at Points O and T. (We know that this is not true: the maximum value of Δ will occur closer to Point B, thus using θ overestimates rotation at point T. A more accurate check is described below.) Deflection at C (noted as $\Delta_C$)=$\overline{CT}$ sin(θ). Since sin(θ)=(L/2)/R, we get:

$$\Delta_C=\overline{CT}(L/2R) \tag{13}$$

$$\text{Deflection at } C=(10)[30/(2(67))]=2.24 \text{ inches}$$

To achieve our desired 3.5 inches deflection of Point C, we need to adjust the geometry of the system. For the same rotation at point T, we could increase the link extension $\overline{CT}$ by 50% and get 3.36 inches deflection. However, increasing the extension length also increases the moment in the links at point T, thus increasing the reaction at point B, and requiring a wider structural fuse 16. Widening the structural fuse means our radius of curvature increases, leading to a smaller angle of rotation at point T.

To avoid the cascading effect just described, we can try lengthening the distance between points T and B; this will encompass a greater arc length, quickly increasing the link rotation at Point T.

Our earlier calculation of Δ+d/2 gave 3.37 inches, compared to an available distance $T_k$ of 5.44 inches. We can therefore increase Δ to be equal 5.44−d/2, or 5.44−1.67=3.77 inches.

Substituting Δ of 3.37 inches into (11), along with $R_C$ as previously determined, we solve for L:

$$L=2\sqrt{2(67)(3.77)-(3.77)^2}=44 \text{ inches.}$$

Using our new L to find the new deflection at point C: for a ½ inch thick, 44 inches long structural fuse 16, $\Delta_C$=10 [44/2(67)]=3.28 inches.

Even though the structural fuse 16 is almost 50% longer than before, the width at the midpoint has not changed in this example. This is because the "input moment" in the link at Point T has not changed: it is still 148 in−k.

We could also use thicker stock for the structural fuse 16, which allows a shorter structural fuse 16 (and more importantly, shorter and stiffer retention plate 28 and smaller width-to-thickness ratio for the flanges 38). Working through the process for 1 inch thick structural fuses gives the following:

$$d_{top}=\sqrt{3(4.93\text{k})(28.5\text{in})(1.5)/(1\text{in})(50\text{k/in}^2)}=3.56 \text{ inches}$$

$$d_{mid}=\sqrt{3(4.93\text{k})(15\text{in})(1.25)/(1\text{in})(50\text{k/in}^2)}=2.36 \text{ inches}$$

$$d_{bot}=\sqrt{3(4.93\text{k})(1.5\text{in})(1.0)/(1\text{in})(50\text{k/in}^2)}=0.66 \text{ inches}$$

Based on the above we can calculate revised minimum bending radius, etc., and find:

$$R_C=2.36/0.05=47 \text{ inches}$$

$$\Delta=47-\sqrt{47^2-30^2/4}=2.45 \text{ inches}$$

Clearance to within the fillet area of the column 14 is $\Delta+d/2=2.45+(2.36/2)=3.63$ inches, which is less than $T_k/2$ and is therefore acceptable.

For 1 inch thickness and a length of 30 inches, $\Delta_C=10[30/2(47)]=3.20$ inches.

Adding the elastic deflection of the mounting column (approximately 0.25 inch) to this estimated deflection due to plastic deformation of the structural fuse puts us in the desired range of 3 to 4 percent total story drift.

Changing the thickness of the structural fuses to 1 inch leads to a reduction in link width. The reduced width allows a tighter radius without exceeding 5% strain, and also without the link remaining outside of the fillet area of the column 14.

Estimating Elastic Deflection of Point C

In the preceding process we estimated an optimum geometry of components considering the smallest allowable radius at the midpoint of the structural fuse 16 in its assumed fully deformed shape. We also need to compare the initial stiffness of the assembly to WSP shear walls to establish "equivalency" under FEMA P-795. This section explains the method used to determine the elastic deflection of the link.

We know that curvature is not uniform along the structural fuse 16. For strains in the elastic range we know that the radius of curvature, $R_C$, is related to section and steel properties as:

$$R=M/EI \tag{15}$$

Since both M and I vary between Points T and B, the moment-area method is used to determine the rotation angle at Point T and the deflection at Point C. This is easily accomplished using a spreadsheet. Solving for the rotation at Point B is helpful to illustrate theoretical deformation of the link, even though it is not needed otherwise.

By the moment area method (see FIG. 3B), for varying I:

The value of E θ about Point T=summation of $[(y_i)(\text{Area of cross-hatched strip for each i})/(I_i)]/(30\text{ inches})$ Determining the width of the structural fuse 16 along its length, and adding functions to calculate the value of I and the term within the summation may be performed using a spreadsheet. Using 1 inch as our increment i, the term within the summation becomes $(y_i)(y_i)(R_{bot})(1\text{ inch})/(I_i)$.

Deflection at Point C is (θ)(10 inches). Bending of the structural fuse between points C and T makes a negligible addition to this deflection. Spreadsheet calculations give deflection at Point C as 0.15 inch. Roughly calculating the elastic deflection of the column 14 assuming the column height equals the 8-foot ceiling height, for a W14×68 gives 0.23 inch. Thus, total deflection of Point C is 0.38 inch.

The structural fuse 16 contribution is only 40% of the total deflection, so using a stiffer column 14 would have significant effect on the overall deflection. Adjusting the geometry of the structural fuse 16 may be performed to further reduce the total deflection, but may risk introducing low-cycle fatigue and thus reduce ductility.

Sizing Pin Connections at Points C, T, and B

The retrofitting system 10 described up to this point uses bolts 26*a*-26*c* to serve to connect both the retention plates 28 and the structural fuses 16 (acting as pins in the latter connection). In the following section, "pin" and "bolt" are used interchangeably.

Reliable connections improve success of the retrofitting system 10. We need to check two connection parameters: strength of the pins in double shear, and bearing of the pin against the web 34 of the column 14. Bearing in the structural fuses 16 will not govern in any reasonable situation.

The pin connections are preferably designed to deliver the force that develops the full plastic moment capacity of the structural fuses, ($P_{(col)}$) which we calculated earlier to design the column 14.

Deflections depend partly on bolt slip, and in the case of the pin 24*b* at Point T, deflection is magnified by the ratio of $\overline{CB}/\overline{TB}$. Any crushing of the steel of the pins or structural fuse 16 would contribute to slip. Since we might have many cycles that could produce egging of the holes 24*a*-24*c* if bearing stresses reached ultimate steel strength, stress level preferably remains below this level. An additional factor of safety of 1.5 may be used with this in mind.

Recall that we used a factor of 1.95 to multiply the seismic force tributary to the structural fuse to determine the design force for the column 14. Now we increase that by 1.5 and round up to a "Connection Adjustment Factor" of 2.93 (rounded up to 3).

For bolt bearing capacity we use the limit of $F_{allowable}=F_u$, (bolt diameter) ($t_w$). To avoid egging we do not factor $F_u$ up by 1.2. We can solve for the bolt diameter as:

$$d_{bolt}=3F/(F_u)t_w \tag{16}$$

Using $F_u$ of 65 ksi for Grade 50 material, the required bolt diameter at Point C is:

$$d_{bolt}=3(14.8k)/(65\text{ ksi})0.415\text{ inch}=1.65\text{ inches at Point C}$$

We find the other bolt sizes to be 2.2 inches at Point T and 0.55 inches at Point B. Translating to incremental bolt sizes, moving from top to bottom of the assembly we would choose 1¾ inch, 2¼ inch, and ⅝ inch bolts.

The above calculations were intended to limit increased slip due to crushing of steel adjacent to bolts. Such a failure would lead to somewhat increased deflections, but not to catastrophic failure. Since failure of the bolt itself could lead to collapse, using a higher safety factor to calculate required bolt capacity is prudent. We choose 5 for this safety factor.

Again moving from top to bottom of the assembly, and using 5 instead of 3 in (16), our factored forces are: 74 k, 99 k, and 25 k. Factored load at the bottom exceeds the capacity of a ⅝ inch diameter A325-X bolt, so we increase to ¾ inch or ⅞ inch bolt diameter.

Balancing Variables in Link Geometry

Using the retrofitting structure 10 as a bracing method is particularly useful where the available width in a structure to be braced is restricted. The retrofitting structure 10 may be used where the clearance to obstructions is less than an inch. Some of the trade-offs between variables are outlined below:

- Wider structural fuses 16 require larger radii of curvature to stay within strain limitations
- Larger radii of curvature mean greater fuse length is needed to achieve ultimate deflection to match deflection in parts of the building's LFRS
- Wider structural fuses 16 require wider columns 14 to accommodate a given radius of curvature
- Changing the link thickness requires changing the link width by the square root of the ratio of the thicknesses to maintain the same section modulus
- Lengthening the distance between points B and T accommodates larger radii, but may lead to the retention plate 28 bowing away from the structural fuse 16 and allowing buckling
- Moderate changes to the extension length allow adjusting drift at peak load, but require iteration Comparison To Wsp Shear Walls One of the requirements in FEMA P-795 to establish "component equivalency" is that the initial stiffness of the proposed component compares well with the reference component (in this case a WSP shear wall). The other factors needed to establish equivalency require more sophisticated testing than has been done to date.

The required length of WSP shear wall needed to resist 14.8 k would be 14.8 k/0.870 k/ft using ASD for ½ inch thick shear panels nailed with 10-penny nails at 2 inch edge nail spacing), or 17 feet of shear panels.

Equations and factors for calculating the deflection of WSP shear walls are given in the SDPWS published by the American Wood Council (AWC, 2008), which is hereby incorporated herein by reference in its entirety. For a WSP shear wall:

$$\delta_{SW}=(8vh^3/EAb)+(vh/1000G_a)+(h\Delta_a/b) \quad (17)$$

Where:

$\delta_{SW}$=deflection of shear wall (inches)

v=870 (unit shear in shear wall, pounds/foot)

h=8 (shear wall height, feet)

E=1,600,000 (modulus of elasticity for end posts, psi)

A=12.25 (cross-sectional area of shear wall end posts, $in^2$)

b=17 (width of shear wall, feet)

$G_a$=28*1.2 (tabulated value from SDPWS, increased by 1.2 as allowed for 5-ply Structural I plywood)

$\Delta_a$=0.1 (slip & elongation in anchorage for end posts, $in^2$)

Substituting into the above equation we get: $\delta_{SW}$=0.29 inch

Initially, the WSP shear wall deflection does not appear to compare well with the 0.38 inch total deflection for the retrofitting structure 10 calculated earlier. However, the majority of the link/column deflection is attributed to the column, and could be compensated for. The WSP shear wall deflection also depends on aspect ratio. If a double-sided shear wall 8.5 feet long was used, predicted WSP deflection increases to 0.32 inch.

When used at opposite ends of a flexible diaphragm, one might question whether a difference in deflection of 0.15 inch between the retrofitting system 10 versus a WSP shear wall would have noticeable or detrimental effect.

Installation and Connections to Wood Framing Above

Connections to framing above will vary depending on the existing construction. In some embodiments, steel angles may be secured to joists on either side of a joist bay using structural screws. This distributes the force along two joists, thus lessening concerns about the capacity of the existing floor diaphragm. A steel channel may be bolted to the outstanding legs of the angles and span across the joist bay. The loading structure 18 can bolt to the channel. Other connection methods could include securing the loading structure 18 to the underside of existing framing directly, using structural screws or other appropriate fasteners. Depending on capacity of the existing floor diaphragm above the retrofitting structure 10 it may be necessary to install plywood to the underside of the framing members to distribute load further.

The column 14 may be installed by excavating for the foundation, suspending the column 14 from the floor framing as described above, assembling a rebar cage around the column 14, and then place the concrete for the new foundation beam.

Alternative Embodiments

Figure 4:
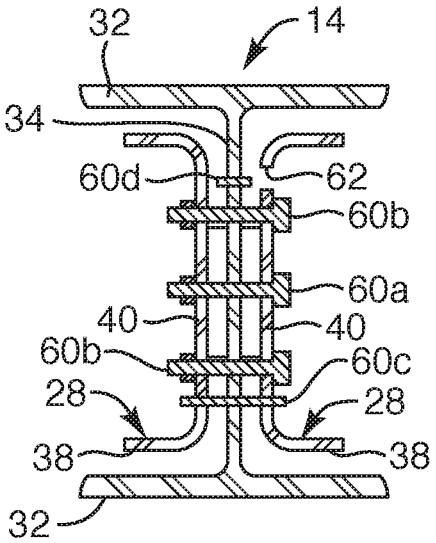
FIG. 4 is top cross-sectional view of the retrofitting structure including sacrificial shear pins in accordance with an embodiment of the present invention.

Referring to FIG. 4, to be considered as a substitute for WSP shear walls, the initial stiffness of the assembly needs to be similar to the initial stiffness of a WSP shear wall. Analysis using the moment-area method for the structural fuse 16 described in the design example suggests an elastic deflection of 0.15 inch at the assumed yield point. Deflection of the W14×68 used as the column 14 contributes more than the structural fuse to total story drift, but reducing the structural fuse's contribution could prove helpful.

One possible method to reduce initial deflection in the structural fuse 16 is to add one or more sacrificial shear pins somewhere along the active length of the structural fuse 16. The shear pin would be sized to shear through when the lateral load applied to the structural fuses 16 through the loading structure 18 approaches a peak design force. FIG. 4 shows a section through the retrofitting assembly 10 with various possible locations of shear pins. Location of shear pins along the structural fuse 16 could occur anywhere between points T and B, and multiple shear pins could be used.

In one approach, one or more shear pins 60*a* extend through all of the web 40 of the retention plate, structural fuses 16, and column web 34, which gives four shear planes, allowing for drilling smaller holes and thus a smaller reduction in the structural fuses' section properties. The structural fuse 16 may be widened where the shear pin 60*a* passes through it in order to retain the same section properties as without the hole for the shear pin 60*a*. The material of the shear pin 60*a* is preferably softer than steel so as not to score the structural fuses 16 as they pass back and forth against the rough end of the failed pin 60*a*. Brass, aluminum, or even plastic could be used.

In another embodiment, one or more shear pins 60*b* are placed against either side of the structural fuses 16 and extending through the webs 40 of the retention plate 28 and the web 34 of the column 14.

In another embodiment, one or more shear pins 60*c* pass through the webs 40 of the retention plates 28 and through the web 34 of the column 14, but not through the structural fuses 16. In this approach, the shear pin 60*c* operates as an indicator. The head of the shear pin 60*c* may be come loose or fall out of the hole in the web 40 when the structural fuse 16 moves far enough to shear it off.

In yet another embodiment, one or more shear pins 60*d* pass through only the web 34 of the column 14. This permits the sheared ends of the shear pins 60*d* to fall off once sheared through. An observation hole 62 may be formed in the web 40 enabling the state of the shear pin 60*d* to be observed.

The shear pins 60*c* and/or 60*d* may be used to indicate that the structural fuse 16 experienced a particular amount of movement, and could serve as an indication that the structural fuses 16 should be replaced. Shear pins 60*c*, 60*d* could be located at various places to show maximum movement of the structural fuse 16.

Figure 5A:
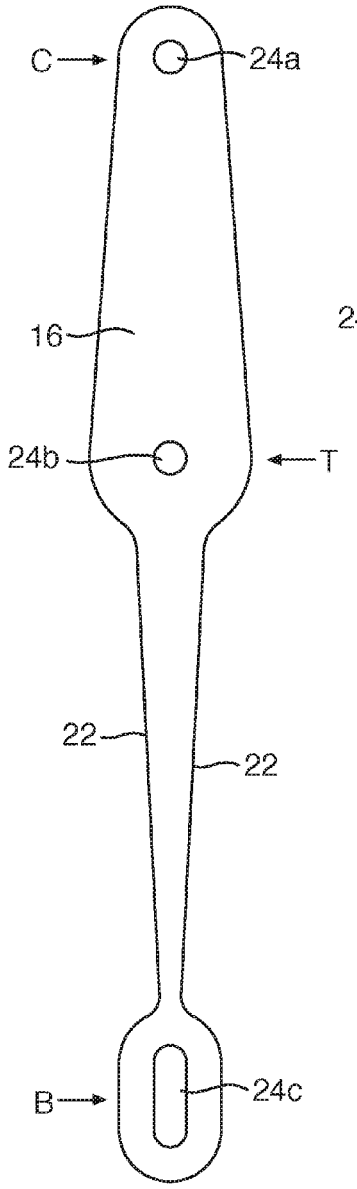
FIGS. 5A and 5B are front views of alternative embodiments of structural fuses in accordance with an embodiment of the present invention.

Referring to FIG. 5A, various alternative geometries of the structural fuse 16 are possible. The extension between points T and C decreases in width with distance from point C. As is also apparent, the portion of the structural fuse surrounding aperture 24*b* is wider than in other embodiments.

Figure 5B:
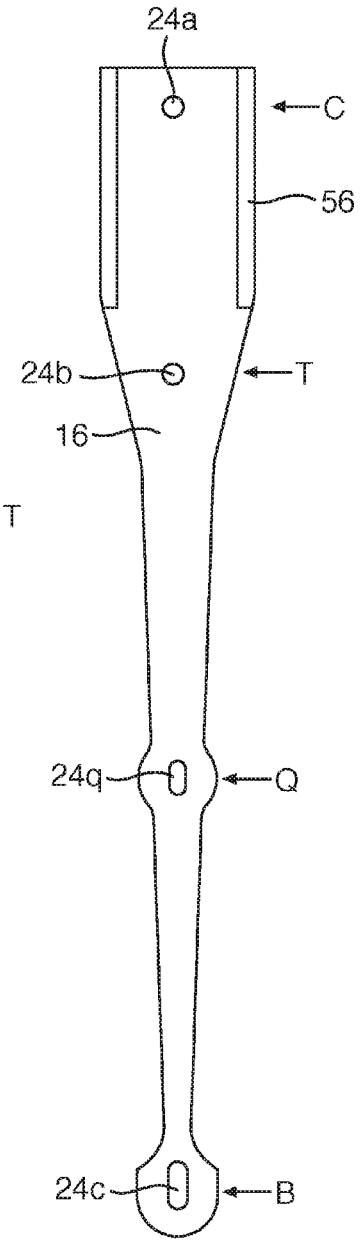

Referring to FIG. 5B, in another alternative embodiment, the structural fuse 16 is additionally pinned to the column 14 at a point Q that is located between points B and T, such as halfway between points B and T, such as by means of an aperture 24*q* formed in the structural fuse 16. A portion of the structural fuse surrounding the aperture 24*q* may be enlarged to prevent yielding around the aperture 24*q*.

Figure 5C:
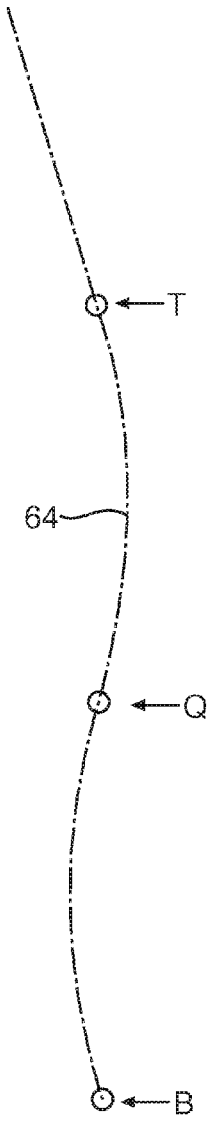
FIG. 5C is a diagram illustrating deformation of the centerline of the structural fuse in FIG. 5B.

For the structural fuse 16 of FIG. 5B, the centerline 64 of the structural fuse 16 deflects as shown in FIG. 5C in response to a lateral load, resulting in two arcuate regions between points B and Q and between points Q and T.

In addition, the structural fuse 16 may include flanges 56 on the edges of the structural fuse 16 extending above point T in order to stiffen this region and ensure that yielding only occurs in the active region. Flanges 56 may be incorporated into the extensions of any of the structural fuses 16 described herein. A retention plate 28 may secure to the column 14 over the structural fuse of FIGS. 5A and 5B in the same manner as for other embodiments disclosed herein. For the embodiment of FIG. 5B, the pin inserting through aperture 24*q* may also insert through an additional corresponding aperture in the retention plate 28.

Referring to FIGS. 6A to 6G, in another alternative embodiment, the retention plate 28 is permitted to pivot about point T. Accordingly, the additional fasteners 30 may be omitted in these embodiments.

As shown in FIGS. 6A and 6B, the retention plate 28 is pinned at point T and at point B. The retention plate 28 includes an arcuate slot 70 centered on point T that receives the bolt 26*c*, which is permitted to slide within the slot 70 but is pinned in the longitudinal direction 12*c* to the column 14 by the bolt 26*c*. The retention plate 28 may also be pinned to the loading structure 18 by the bolt 26*a* along with the structural fuse 16.

The pivoting of the portion of the retention plate below point T is in the same direction as the bowing of the structural fuse 16 between points B and T. In particular, moving closer to point T from point B, the movement of the retention plate 28 becomes closer to the movement of the structural fuse 16, thereby reducing friction between the structural fuse 16 and the retention plate 28. Accordingly, widening of the structural fuse 16 with distance from point B to point T according to the CIF may be reduced or eliminated in the embodiment of FIGS. 6A to 6G inasmuch as friction is reduced at the top of the active region.

In some embodiments, a damper 72 may couple the retention plate 28 to the column 14. The damper 72 may be any damping element known in the art, such as a piston and cylinder combination incorporating a viscous fluid in the piston for resisting movement of the piston within the cylinder. Alternatively, the damper 72 may be omitted and damping may be provided by friction between the structural fuse 16 and the retention plate 28 and column 14.

Figure 6D:
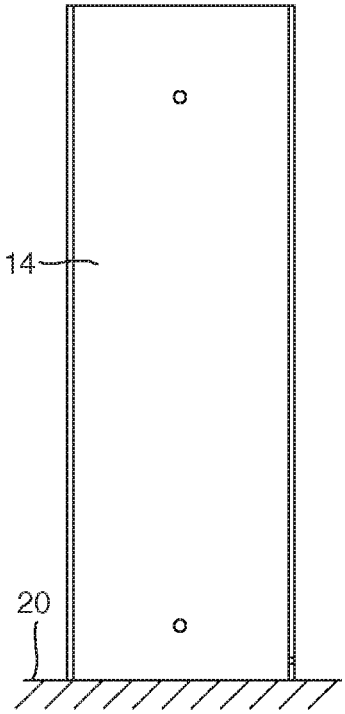
FIG. 6D is a front view of a mounting column for the retrofitting structure of FIG. 6A in accordance with an embodiment of the present invention.

Referring to FIG. 6C, the retention plate 28 may be a channel beam having flanges 38 and web 40 as for the other embodiments disclosed herein. The width of the retention plate 28 may be smaller relative to the separation of the flanges 32 of the column 14 as compared to the embodiments described above in order to permit rotation of the retention plate 28. This may be accomplished by narrowing the retention plate 28 relative to the embodiment of FIGS. 1A to 1G or widening of the column 14, as shown in FIG. 6D.

In another embodiment, the retention plate 28 may be T-shaped. A T-shaped retention plate 28 may also be substituted for the retention plate 28 of any of the embodiments disclosed herein. As for the embodiment described above, structural fuses 16 may be positioned on either side of the web 34 of the column 14 and a pair of retention plates 28 may be positioned on outward facing surfaces of the structural fuses 16 as shown.

Figure 6E:
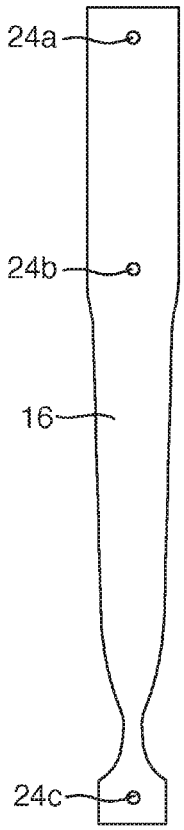
FIG. 6E is a front view of a structural fuse for the retrofitting structure of FIG. 6A in accordance with an embodiment of the present invention.

Referring to FIG. 6E, the structural fuse 16 may have the same general geometry for the embodiments described above selected according to the same design considerations described above. However, adjustments based on reduced friction may be made due to co-rotation with the retention plate 28 along the upper portions of the active region. Likewise, the column 14 and retention plate 28 for the embodiment of FIGS. 6A to 6G may be designed according to the same design criteria outlined above.

Figure 6F:
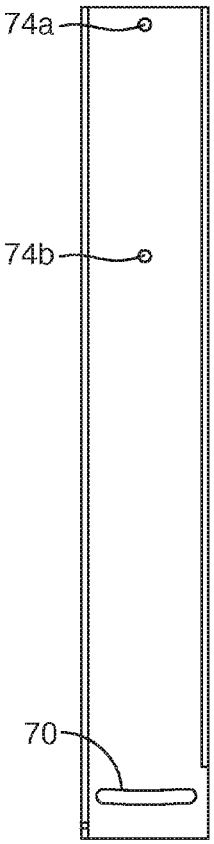
FIGS. 6F and 6G are front views of retention plates for the retrofitting structure of FIG. 6A in accordance with an embodiment of the present invention.
Figure 6G:
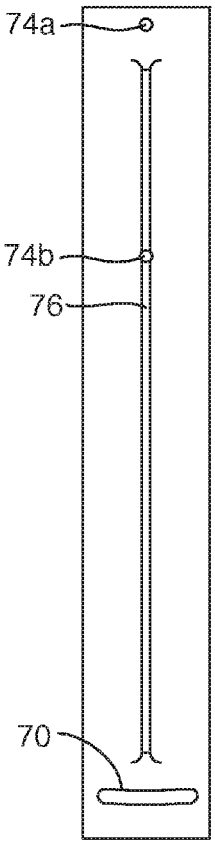

Referring to FIG. 6F, the retention plate 28 may include apertures 74*a*, 74*b* for receiving the bolts 26*a*, 26*b*, in addition to the arcuate slot 70. Referring to FIG. 6G, in another embodiment, a T-shaped retention 28 plate is used with a stem 76 protruding outwardly form the retention plate and providing additional stiffness. In this embodiment the aperture 24*b* must be located beneath the stem 76, requiring removal of material from the stem 76 to accommodate the bolt 26*b*.

REFERENCES

The following references are hereby incorporated herein by reference in their entirety:

AISC 341-10, 2010, *Seismic Provisions for Structural Steel Buildings* pp. 9.1-3 to 9.1-4, American Institute of Steel Construction, Chicago, Ill.

ASCE, 2010, ASCE 7-10, *Minimum Design Loads for Buildings and Other Structures*, American Society of Civil Engineers, Reston, Va.

ASCE, 2016, ASCE 7-16, *Minimum Design Loads for Buildings and Other Structures*, American Society of Civil Engineers, Reston, Va.

American Wood Council, 2008, *Special Design Provisions for Wind and Seismic*, American Forest and Paper Association, Washington, D.C.

California Building Standards Commission, 2013, Appendix Chapter A4, *California Existing Building Code*, p. 116, California Building Standards Commission, Sacramento, Calif.

FEMA, 2011, "*Quantification of Building Seismic Performance Factors: Component Equivalency Methodology*" FEMA P-795. US Dept. of Homeland Security, Federal Emergency Management Agency, Catalog No. 11206-2.

Ozaki-Train, R., Johnson, G., and Robertson, I.; *Hybrid Masonry Connector Development Phase II*, Research Report UHM/CEE/11-04, December 2011, University of Hawaii College of Engineering, Manoa, Hi.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus comprising:

a column defining a first column end and a second column end offset from one another along the vertical direction; and a structural fuse defining a first attachment point, a second attachment point, and a third attachment point, the second attachment point being positioned between the first and third attachment points, the structural fuse being pivotally secured to the column at the second and third attachment points having the first attachment point extending beyond the first column end;

wherein the structural fuse is configured to yield in response to a load in a horizontal direction perpendicular to a vertical direction and applied at the first attachment point that is insufficient to cause yielding of the column.

2. The apparatus of claim 1, further comprising a building defining a superstructure offset from a ground plane, the first attachment point being secured to the superstructure and the column being rigidly anchored to the ground plane.

3. The apparatus of claim 2, wherein the structural fuse is effective to provide a seismic response factor of at least 6.5 for the building.

4. The apparatus of claim 2, further comprising a mounting structure secured to the superstructure, the mounting structure defining a slot having a long dimension oriented in the vertical direction, the structural fuse being pinned at the first attachment point through the slot.

5. The apparatus of claim 1, further comprising a retention plate, a portion of the structural fuse between the second and third attachment points being sandwiched between the retention plate and the column.

6. The apparatus of claim 5, wherein the retention plate is pivotally mounted to the column coaxially at the second attachment point.

7. The apparatus of claim 6, wherein the retention plate defines an arcuate slot, the third attachment point being secured to the column by a pin extending through the arcuate slot, the apparatus further comprising a damper coupling the retention plate to the column.

8. The apparatus of claim 1, wherein:

the column is an I beam defining first and second flanges and a web extending between the first and second flanges, the second and third attachment points are pivotally secured to the web.

9. The apparatus of claim 1, wherein a first separation between the first and second attachment points is greater than a second separation between the second and third attachment points.

10. The apparatus of claim 1, wherein the third attachment point is a slot having a long dimension oriented parallel to the vertical direction.

11. The apparatus of claim 10, wherein the increasing width with distance from the third attachment point toward the second attachment point is effective to cause the structural fuse to yield substantially simultaneously along a length of the structural fuse between the second and third attachment points.

12. The apparatus of claim 1, wherein the structural fuse is a planar member having uniform thickness perpendicular to the horizontal direction, the structural fuse having an increasing width with distance from the third attachment point toward the second attachment point.

13. The apparatus of claim 11, wherein the width increases with the distance from the third attachment point toward the second attachment point according to a square root of the distance.

* * * * *